US009361892B2

(12) United States Patent
Kawashima et al.

(10) Patent No.: US 9,361,892 B2
(45) Date of Patent: Jun. 7, 2016

(54) ENCODER APPARATUS AND METHOD THAT PERFORM PRELIMINARY SIGNAL SELECTION FOR TRANSFORM CODING BEFORE MAIN SIGNAL SELECTION FOR TRANSFORM CODING

(75) Inventors: Takuya Kawashima, Ishikawa (JP); Masahiro Oshikiri, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 303 days.

(21) Appl. No.: 13/820,760

(22) PCT Filed: Sep. 5, 2011

(86) PCT No.: PCT/JP2011/004960

§ 371 (c)(1),
(2), (4) Date: Mar. 5, 2013

(87) PCT Pub. No.: WO2012/032759

PCT Pub. Date: Mar. 15, 2012

(65) Prior Publication Data

US 2013/0166308 A1 Jun. 27, 2013

(30) Foreign Application Priority Data

Sep. 10, 2010 (JP) ..... 2010-203657

(51) Int. Cl.
*G10L 19/00* (2013.01)
*G10L 19/24* (2013.01)
(Continued)

(52) U.S. Cl.
CPC ..... *G10L 19/00* (2013.01); *G10L 19/24* (2013.01); *G10L 19/0212* (2013.01); *G10L 19/12* (2013.01); *G10L 19/20* (2013.01)

(58) Field of Classification Search
None
See application file for complete search history.

(56) References Cited

U.S. PATENT DOCUMENTS 6,263,312 B1 * 7/2001 Kolesnik et al. ..... 704/500
8,315,863 B2 11/2012 Oshikiri
(Continued)

FOREIGN PATENT DOCUMENTS

CN 101199005 6/2008
CN 101273404 9/2008
(Continued)

OTHER PUBLICATIONS

Ehara et al., "Development of 32 kbit/s scalable wide-band speech and audio coding algorithm using high-efficiency code-excited linear prediction and band-selective modified discrete cosine transform coding algorithms", pp. 196-207, 2008 (together with its partial English translation).
(Continued)

*Primary Examiner* — Vincent Rudolph
*Assistant Examiner* — Richa Mishra
(74) *Attorney, Agent, or Firm* — Greenblum & Bernstein, P.L.C.

(57) ABSTRACT

An encoder apparatus is provided that suppresses the quality degradation of encoding processes. An ultimate selection candidate limiting unit uses the spectrum of an input signal and a residual spectrum to designate a given number of pre-selected suppression factors to a CELP component suppressing unit, which uses the designated suppression factors to generate a suppressed spectrum. A CELP residual signal spectrum calculating unit, to which the suppressed spectrum is input, calculates a residual spectrum. A conversion encoding unit uses the residual spectrum to perform a second encoding process. A distortion evaluating unit determines one of the designated suppression factors by use of the spectrum of a second decoded signal generated by decoding a second code obtained by the second encoding process, and further by use of the suppressed spectrum and the spectrum of the input signal.

15 Claims, 3 Drawing Sheets

(51) Int. Cl.

| | |
|---|---|
| *G10L 19/02* | (2013.01) |
| *G10L 19/12* | (2013.01) |
| *G10L 19/20* | (2013.01) |

(56) References Cited

U.S. PATENT DOCUMENTS

| | | | | |
|---|---|---|---|---|
| 8,396,717 | B2 | 3/2013 | Oshikiri | |
| 2009/0112607 | A1 | 4/2009 | Ashley et al. | |
| 2009/0157413 | A1* | 6/2009 | Oshikiri | 704/501 |
| 2009/0216527 | A1 | 8/2009 | Oshikiri | |
| 2009/0281811 | A1 | 11/2009 | Oshikiri et al. | |
| 2010/0017200 | A1 | 1/2010 | Oshikiri et al. | |
| 2010/0049512 | A1 | 2/2010 | Oshikiri et al. | |

FOREIGN PATENT DOCUMENTS

| | | |
|---|---|---|
| JP | 2009-42739 | 2/2009 |
| JP | 2009-094666 | 4/2009 |
| WO | 2007/043648 | 4/2007 |
| WO | 2008/072733 | 6/2008 |

OTHER PUBLICATIONS

Oshikiri et al., "An 8-32 kbit/s Scalable Wideband Coder Extended with MDCT-based Bandwidth Extension on top of a 6.8 kbit/s Narrowband CELP Coder", Next-Generation Mobile Communication Development Center, Matsushita Electric (Panasonic), Japan, pp. 465-468, 8th Annual Conference of the International Speech Communication Association, Interspeech 2007, vol. 1, Antwerp, Belgium, Aug. 27-31, 2007.

Yamanashi et al., "ITU-T G. 718—Development of Speech /Audio Codec for Next-Generation Mobile Communication Systems", Panasonic Technical Journal, vol. 55, No. 1, Apr. 2009, pp. 21-26 (together with its English language Abstract and partial English translation).

China Office Action Search Report (in English), mailed Jan. 26, 2014, for corresponding Chinese Patent Application.

"Frame error robust narrow-band and wideband embedded variable bit-rate coding of speech and audio from 8-32 kbits/s", Recommendation ITU-T G.718, Series G: Transmission Systems and Media, Digital Systems and Networks, Digital terminal equipments—Coding of voice and audio signals, Jun. 2008.

Tomofumi Yamanashi et al., "Development of Speech/Audio Codec for Next-Generation Mobile Communication Systems", ITU-T G.718, Panasonic Technical Journal, vol. 55, No. 1, pp. 21-26, Apr. 2009.

International Search Report for International Application No. PCT/JP2011/004960, mailed Dec. 6, 2011.

* cited by examiner

ENCODER APPARATUS AND METHOD THAT PERFORM PRELIMINARY SIGNAL SELECTION FOR TRANSFORM CODING BEFORE MAIN SIGNAL SELECTION FOR TRANSFORM CODING

TECHNICAL FIELD

The present invention relates to a coding apparatus and coding methods.

BACKGROUND ART

A coding method is proposed which combines a CELP (Code Excited Linear Prediction) coding method suitable for a speech signal with a transform coding method suitable for a music signal in a layer structure, as a coding method which can compress speech and music and so forth at a low bit rate and with high sound quality (see for example, Non-Patent Literature 1). Hereinafter, a speech signal and a music signal may be collectively referred to as an audio signal.

In the coding method, a coding apparatus first encodes an input signal by a CELP coding method to generate CELP coded data. The coding apparatus then converts a residual signal (hereinafter, referred to as a CELP residual signal) between the input signal and a CELP decoded signal (a decoded result of the CELP coded data) into the frequency domain to acquire a residual spectrum and performs transform coding on the residual spectrum, thereby providing a high sound quality. A transform coding method is proposed which generates pulses at frequencies having a high residual spectrum energy and encodes information of the pulses (see, Non-Patent Literature 1).

While the CELP coding method is suitable for speech signal coding, the coding model of the CELP coding method is different from that of a music signal, and therefore sound quality degrades in coding the music signal through the CELP coding method. For this reason, the CELP residual signal component is large when the music signal is encoded by the above coding method, and thereby raising a problem that sound quality is less likely to be improved in encoding the CELP residual signal (residual spectrum) by the transform coding.

To solve this problem, a coding method (a CELP component suppressing method) is proposed which suppresses the amplitude of a frequency component of the CELP decoded signal (hereinafter, referred to as a CELP component) to calculate a residual spectrum and performs transform coding on the calculated residual spectrum to provide high sound quality (see, for example, Patent Literature 1 and Non-Patent Literature 1 (section 6.11.6.2)).

The CELP component suppressing method disclosed in Non-Patent Literature 1 suppresses the amplitude of the CELP component (hereinafter, referred to as CELP suppressing) in only a middle band of 0.8 kHz to 5.5 kHz when a sampling frequency for an input signal is 16 kHz. In Non-Patent Literature 1, the coding apparatus does not directly perform transform coding on the CELP residual signal, and reduces the residual signal of a CELP component by another transform coding method beforehand (see, for example, Non-Patent Literature 1 (Section 6.11.6.1)). For this reason, the coding apparatus does not perform CELP suppressing on a frequency component coded by the other transform coding method even in the middle band. A CELP suppressing coefficient indicating the degree of CELP suppressing (level) is constant in frequencies in the middle band other than frequencies in which the CELP suppressing is not performed. The CELP suppressing coefficients are stored in a code book (hereinafter, referred to as a CELP suppressing coefficient code book) according to the level of the CELP suppressing. The CELP suppressing coefficient code book stores a coefficient (=1.0) meaning that no CELP component is suppressed.

The coding apparatus performs CELP suppressing by multiplying the CELP component (a CELP decoded signal) by the CELP suppressing coefficient stored in the CELP suppressing coefficient code book before the transform coding, acquires the residual spectrum between the input signal and the CELP decoded signal (a CELP decoded signal after the CELP suppressing), and performs transform coding on the residual spectrum. This transform coding is performed for all CELP suppressing coefficients. The coding apparatus then calculates a residual signal between the input signal and a signal obtained by adding a decoded signal of the transform-coded data and the CELP decoded signal in which the CELP component is suppressed, determines a CELP suppressing coefficient such that an energy of the residual signal (hereinafter, referred to as a coding distortion) is minimum, and encodes the searched CELP suppressing coefficient (a CELP suppressing coefficient such that the coding distortion is minimum). By this means, the coding apparatus can perform transform coding which minimizes the coding distortion in all bands. Hereinafter, a series of processes in which transform coding is performed for each CELP suppressing coefficient and a CELP suppressing coefficient is determined such that a coding distortion (an energy of the residual signal) is minimum is referred to as a "main selection."

Meanwhile, a decoding apparatus suppresses the CELP component of the CELP decoded signal using the CELP suppressing coefficient transmitted from the coding apparatus and adds a decoded signal subjected to transform coding to the CELP decoded signal in which the CELP component is suppressed. This allows the decoding apparatus to acquire a decoded signal having less deterioration of sound quality due to CELP coding when performing coding which combines the CELP coding and the transform coding in a layer structure.

CITATION LIST

Patent Literature

PTL 1
U.S. Patent Application Publication No. 2009/0112607 Specification

Non-Patent Literature

NPL 1
Recommendation ITU-T G.718, June, 2008

SUMMARY OF INVENTION

Technical Problem

However, when evaluation of a coding distortion (hereunder, may be referred to as "distortion evaluation") is performed by performing transform coding for each CELP suppressing coefficient stored in a CELP suppressing coefficient code book by the above CELP component suppressing method, since it is necessary to perform transform coding for all CELP suppressing coefficient candidates, that is, for all the CELP suppressing coefficients that are stored in the CELP suppressing coefficient code book, there is the problem that the workload in the coding apparatus becomes extremely large.

It is an object of the present invention to provide a coding apparatus and a coding method that can reduce a workload at a coding apparatus while suppressing a deterioration in the quality of encoding by selecting (hereunder, referred to as "preliminary selection") a part of input signals (hereunder, referred to as "target signals") for a transform coding process that are generated for each CELP suppressing coefficient, to thereby limit targets on which transform coding is performed in a main selection.

Solution to Problem

A coding apparatus according to one aspect of the present invention includes: a first coding section that outputs a spectrum of a first decoded signal that is generated by decoding a first code obtained by a first encoding of an input signal; a suppressing section that suppresses an amplitude of the spectrum of the first decoded signal using a suppressing coefficient that is specified from among a plurality of suppressing coefficients, to generate a suppressed spectrum; a residual spectrum calculating section that calculates a residual spectrum using a spectrum of the input signal and the suppressed spectrum; a preliminary selecting section that preliminarily selects a predetermined number of suppressing coefficients using the spectrum of the input signal and the residual spectrum, and specifies the preliminarily selected suppressing coefficients to the suppressing section; and a second coding section that performs a second encoding using a residual spectrum that is calculated by inputting into the residual spectrum calculating section a suppressed spectrum that is generated using the specified suppressing coefficient in the suppressing section, and determines one suppressing coefficient among the specified suppressing coefficients using a spectrum of a second decoded signal that is generated by decoding a second code obtained by the second encoding, the suppressed spectrum and the spectrum of the input signal.

A coding method according to one aspect of the present invention includes: a first coding step of outputting a spectrum of a first decoded signal that is generated by decoding a first code obtained by a first encoding of an input signal; a suppressing step of suppressing an amplitude of the spectrum of the first decoded signal using a suppressing coefficient that is specified from among a plurality of suppressing coefficients, to generate a suppressed spectrum; a residual spectrum calculating step of calculating a residual spectrum using a spectrum of the input signal and the suppressed spectrum; a preliminary selection step of preliminarily selecting a predetermined number of suppressing coefficients that are used in the suppressing step using the spectrum of the input signal and the residual spectrum, and setting the preliminarily selected suppressing coefficients as the specified suppressing coefficients; and a second coding step of performing a second encoding using a residual spectrum that is calculated in the residual spectrum calculating step using a suppressed spectrum that is generated using the specified suppressing coefficient in the suppressing step, and determining one suppressing coefficient among the specified suppressing coefficients using a spectrum of a second decoded signal that is generated by decoding a second code obtained by the second encoding, the suppressed spectrum and the spectrum of the input signal.

Advantageous Effects of Invention

According to the present invention, in a coding method which combines coding suitable for a speech signal with coding suitable for a music signal in a layer structure, in comparison to a method that successively performs transform coding with respect to all CELP suppressing coefficient candidates, a workload at a coding apparatus can be reduced while suppressing a deterioration in the quality of encoding.

DESCRIPTION OF EMBODIMENTS

Hereinafter, embodiments of the present invention will be explained in detail with reference to the accompanying drawings. A coding apparatus and a decoding apparatus according to the present invention will be described using an audio coding apparatus and an audio decoding apparatus as examples. As described above, a speech signal and a music signal are collectively referred to as an audio signal. In other words, the audio signal represents any of the only substantive speech signal, the only substantive music signal, the mixture of the speech signal and the music signal.

A coding apparatus and a decoding apparatus according to the present invention include at least two coding layers. Hereinafter, CELP coding is employed for coding suitable for a speech signal and transform coding is employed for coding suitable for a music signal as a representative, and the coding apparatus and the decoding apparatus each employ a coding method which combines CELP coding and transform coding in a layer structure.

(Embodiment 1)

Figure 1:
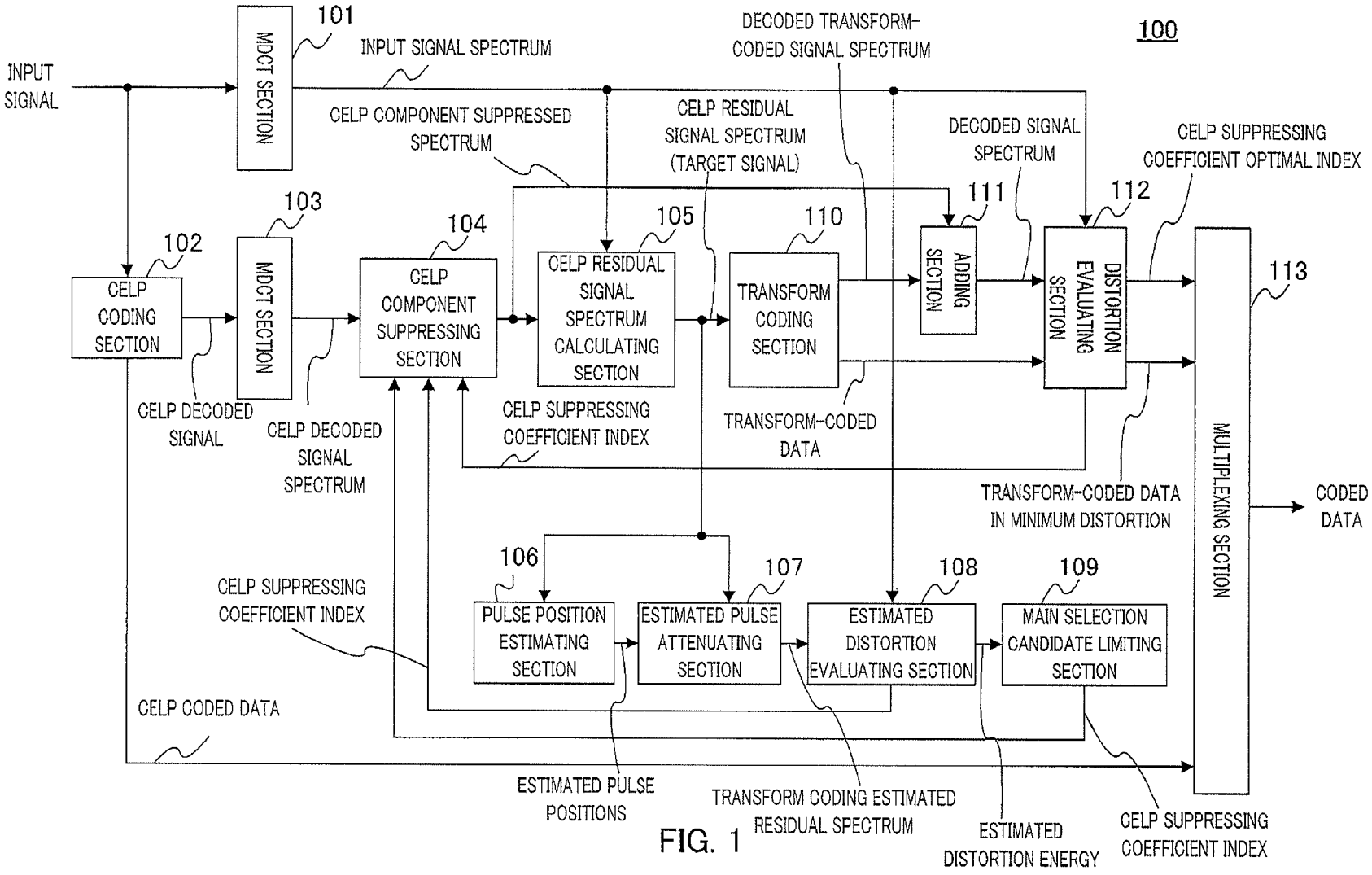
FIG. 1 is a block diagram showing a configuration of a coding apparatus according to Embodiment 1 of the present invention.

FIG. 1 is a block diagram showing a main configuration of coding apparatus 100 according to Embodiment 1 of the present invention. Coding apparatus 100 encodes an input signal such as a speech signal and a music signal through a coding method which combines CELP coding with transform coding in a layer structure and outputs coded data. As shown in FIG. 1, coding apparatus 100 includes modified discrete cosine transform (MDCT) section 101, CELP coding section 102, MDCT section 103, CELP component suppressing section 104, CELP residual signal spectrum calculating section 105, pulse position estimating section 106, estimated pulse attenuating section 107, estimated distortion evaluating section 108, main selection candidate limiting section 109, transform coding section 110, adding section 111, distortion evaluating section 112, and multiplexing section 113. Each section performs the following operations.

In coding apparatus 100 shown in FIG. 1, MDCT section 101 performs a MDCT process on an input signal to generate an input signal spectrum. MDCT section 101 then outputs the generated input signal spectrum to CELP residual signal spectrum calculating section 105, distortion evaluating section 112, and estimated distortion evaluating section 108.

CELP coding section 102 encodes the input signal by a CELP coding method to generate CELP coded data. CELP coding section 102 decodes (local-decodes) the generated CELP coded data to generate a CELP decoded signal. CELP coding section 102 then outputs the CELP coded data to multiplexing section 113 and outputs the CELP decoded signal to MDCT section 103.

MDCT section 103 performs a MDCT process on the CELP decoded signal inputted from CELP coding section 102 to generate a CELP decoded signal spectrum. MDCT section 103 then outputs the generated CELP decoded signal spectrum to CELP component suppressing section 104.

Thus, for example, CELP coding section 102 and MDCT section 103 operate as a first coding section that outputs a spectrum of a first decoded signal generated by decoding a first code acquired by a first encoding on an input signal.

CELP component suppressing section 104 includes a CELP suppressing coefficient code book which stores CELP suppressing coefficients indicating the degree (level) of CELP suppressing. The CELP suppressing coefficient code book, for example, stores four types of CELP suppressing coefficients from 1.0 representing no-suppression to 0.5 representing that the amplitude of a CELP component is reduced to half. In other words, the value of the CELP suppressing coefficient is small as the degree (level) of the CELP suppressing is higher. In this case, it is assumed that, in the CELP suppressing coefficient code book, CELP suppressing coefficients are stored in ascending or descending order of the degree (level) of CELP suppressing. It is also assumed that each CELP suppressing coefficient is assigned an index (a CELP suppressing coefficient index) in ascending or descending order with respect to the degree (level) of CELP suppressing.

CELP component suppressing section 104 first selects the CELP suppressing coefficient from the CELP suppressing coefficient code book in accordance with a CELP suppressing coefficient index inputted from estimated distortion evaluating section 108, main selection candidate limiting section 109, or distortion evaluating section 112. CELP component suppressing section 104 then multiplies each frequency component of the CELP decoded signal spectrum inputted from MDCT section 103 by the selected CELP suppressing coefficient, to calculate a CELP component suppressed spectrum. CELP component suppressing section 104 then outputs the CELP component suppressed spectrum to CELP residual signal spectrum calculating section 105 and adding section 111.

CELP residual signal spectrum calculating section 105 calculates a CELP residual signal spectrum, i.e., a difference between the input signal spectrum inputted from MDCT section 101 and the CELP component suppressed spectrum inputted from CELP component suppressing section 104. To be more specific, CELP residual signal spectrum calculating section 105 acquires the CELP residual signal spectrum by subtracting the CELP component suppressed spectrum from the input signal spectrum. CELP residual signal spectrum calculating section 105 then outputs the CELP residual signal spectrum to transform coding section 110, pulse position estimating section 106, estimated pulse attenuating section 107.

Pulse position estimating section 106 estimates pulse positions (for example, frequencies having a large amplitude of the CELP residual signal spectrum) that are encoded by transform coding section 110, using the CELP residual signal spectrum (target signal for transform coding; hereunder, may be referred to as "target signal") that is inputted from CELP residual signal spectrum calculating section 105. Pulse position estimating section 106 then outputs the pulse positions that were estimated (estimated pulse positions) to estimated pulse attenuating section 107.

Estimated pulse attenuating section 107 attenuates the amplitude at the estimated pulse positions that are inputted from pulse position estimating section 106 in the CELP residual signal spectrum that is inputted from CELP residual signal spectrum calculating section 105. Estimated pulse attenuating section 107 then outputs a spectrum after the attenuation to estimated distortion evaluating section 108 as a transform coding estimated residual spectrum.

Estimated distortion evaluating section 108 calculates an estimated distortion energy that is an estimated value of a coding distortion (distortion energy) that is due to transform coding, using the input signal spectrum that is inputted from MDCT section 101, and the transform coding estimated residual spectrum that is inputted from estimated pulse attenuating section 107. Estimated distortion evaluating section 108 then outputs the estimated distortion energy to main selection candidate limiting section 109.

Estimated distortion evaluating section 108 outputs a CELP suppressing coefficient index that is an evaluation target to CELP component suppressing section 104 in order to obtain a transform coding estimated residual spectrum corresponding to the CELP suppressing coefficient that is an evaluation target in a preliminary selection search that is described later. For example, when calculating an estimated distortion energy for a CELP suppressing coefficient index j=1, estimated distortion evaluating section 108 outputs the CELP suppressing coefficient index j=1 to CELP component suppressing section 104. Estimated distortion evaluating section 108 then calculates an estimated distortion energy for a transform coding estimated residual spectrum (corresponding to CELP suppressing coefficient index j=1) that is a result of the sequential processing at CELP component suppressing section 104, CELP residual signal spectrum calculating section 105, pulse position estimating section 106 and estimated pulse attenuating section 107.

Main selection candidate limiting section 109 limits CELP suppressing coefficient candidates (CELP suppressing coefficients to be used in transform coding) that are searched for in a main selection search, described later, among the CELP suppressing coefficients stored in the CELP suppressing coefficient code book, based on the distribution of the estimated distortion energy that is inputted from estimated distortion evaluating section 108. Main selection candidate limiting section 109 then outputs CELP suppressing coefficient indices indicating the limited CELP suppressing coefficient candidates to CELP component suppressing section 104. Hereinafter, the CELP suppressing coefficient candidates that have been limited at this time may be referred to collectively as a "CELP suppressing coefficients group." Further, CELP suppressing coefficient indices corresponding to the limited CELP suppressing coefficient candidates may be referred to collectively as a "CELP suppressing coefficient indices group."

Thus, for example, pulse position estimating section 106, estimated pulse attenuating section 107, estimated distortion evaluating section 108 and main selection candidate limiting section 109 operate as a preliminary selecting section that preliminarily selects a predetermined number of CELP suppressing coefficients using an input signal spectrum and a CELP residual signal spectrum, and specifies the preliminarily selected CELP suppressing coefficients to CELP component suppressing section 104.

In coding apparatus 100 shown in FIG. 1, CELP component suppressing section 104, CELP residual signal spectrum calculating section 105, pulse position estimating section 106, estimated pulse attenuating section 107, estimated distortion evaluating section 108 and main selection candidate limiting section 109 define a closed loop. The components forming this closed loop search for candidates (CELP suppressing coefficient indices) that are search targets in the main selection search, described later, among the CELP suppressing coefficients stored in the CELP suppressing coefficient code book included in CELP component suppressing section 104, using CELP suppressing coefficients corresponding to the CELP suppressing coefficient indices specified by estimated distortion evaluating section 108. Hereinafter, this search processing is referred to as a "preliminary selection search."

Transform coding section 110 encodes the CELP residual signal spectrum (target signal) inputted from CELP residual signal spectrum calculating section 105 by transform coding to generate transform-coded data. Transform coding section 110 decodes (local-decodes) the generated transform-coded data to generate a decoded transform-coded signal spectrum. At that time, transform coding section 110 performs encoding so as to reduce the distortion between the CELP residual signal spectrum and the decoded transform-coded signal spectrum. Transform coding section 110, for example, performs coding so as to reduce the above distortion by generating pulses at frequencies having a large amplitude (energy) of the CELP residual signal spectrum. Transform coding section 110 then outputs the transform-coded data obtained by encoding to distortion evaluating section 112 and outputs the decoded transform-coded signal spectrum to adding section 111.

Adding section 111 adds the CELP component suppressed spectrum inputted from CELP component suppressing section 104 and the decoded transform-coded signal spectrum inputted from transform coding section 110 to calculate a decoded signal spectrum and outputs the decoded signal spectrum to distortion evaluating section 112.

Distortion evaluating section 112 scans some indices (CELP suppressing coefficient indices that were limited by main selection candidate limiting section 109) of the CELP suppressing coefficients stored in the CELP suppressing coefficient code book included in CELP component suppressing section 104 and searches for a CELP suppressing coefficient index to minimize the distortion (that is, coding distortion due to transform coding) between the input signal spectrum inputted from MDCT section 101 and the decoded signal spectrum inputted from adding section 111. Distortion evaluating section 112 performs CELP suppressing using CELP suppressing coefficients corresponding to some indices above (i.e. distortion evaluating section 112 outputs CELP suppressing coefficient indices) by controlling CELP component suppressing section 104. Distortion evaluating section 112 then outputs a CELP suppressing coefficient index which minimizes the calculated distortion to multiplexing section 113 as a CELP suppressing coefficient optimal index and outputs transform-coded data corresponding to the CELP suppressing coefficient optimal index among transform-coded data inputted from transform coding section 110 to multiplexing section 113 (transform-coded data when distortion is minimum).

Thus, for example, transform coding section 110, adding section 111 and distortion evaluating section 112 operate as a second coding section that performs transform coding (second encoding) using a CELP residual signal spectrum that is calculated by inputting into CELP residual signal spectrum calculating section 105 a CELP suppressed spectrum that is generated using CELP suppressing coefficients specified by the above described preliminary selecting section in CELP component suppressing section 104, and that determines one CELP suppressing coefficient among the specified CELP suppressing coefficients using a decoded transform-coded signal spectrum (a spectrum of a second decoded signal) that is generated by decoding transform-coded data (a second code) obtained by transform coding, a CELP suppressed spectrum and an input signal spectrum.

In coding apparatus 100 shown in FIG. 1, CELP component suppressing section 104, CELP residual signal spectrum calculating section 105, transform coding section 110, adding section 111 and distortion evaluating section 112 define a closed loop. The components forming this closed loop generate a decoded signal spectrum using CELP suppressing coefficients corresponding to CELP suppressing coefficient indices specified by main selection candidate limiting section 109 among a plurality of CELP suppressing coefficients stored in the CELP suppressing coefficient code book included in CELP component suppressing section 104, and search for a candidate (a CELP suppressing coefficient index) which minimizes the distortion (coding distortion due to transform coding) between the input signal spectrum and the decoded signal spectrum. Hereinafter, this search processing is referred to as a "main selection search."

Multiplexing section 113 multiplexes the CELP coded data inputted from CELP coding section 102, the transform-coded data inputted from distortion evaluating section 112 (transform-coded data when distortion is minimized), and the CELP suppressing coefficient optimal index and transmits a multiplexed result to a decoding apparatus as coded data.

Decoding apparatus 200 will now be explained. Decoding apparatus 200 decodes the coded data transmitted from coding apparatus 100 and outputs a decoded signal.

Figure 2:
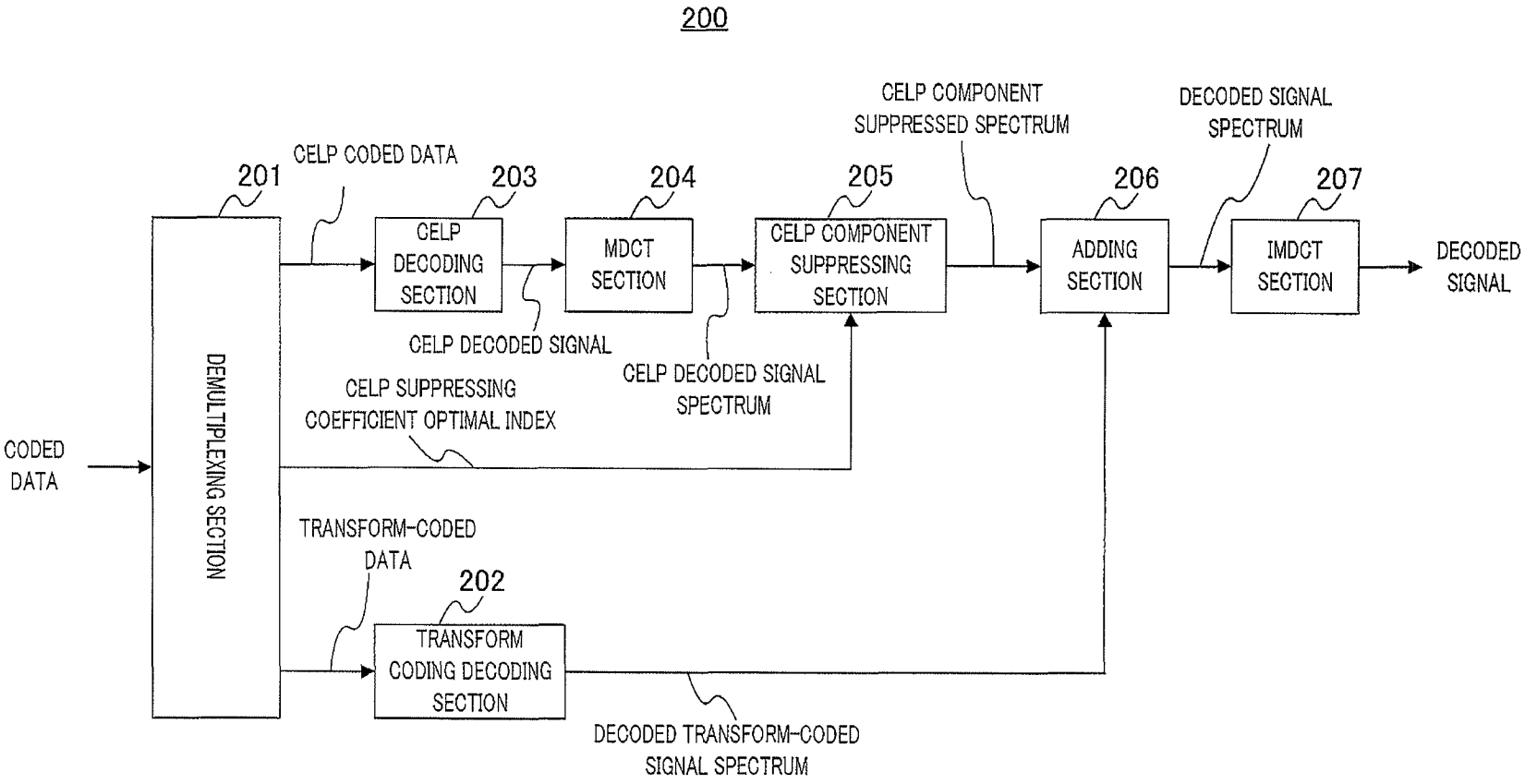
FIG. 2 is a block diagram showing a configuration of a decoding apparatus according to Embodiment 1 of the present invention.

FIG. 2 is a block diagram showing a main configuration of decoding apparatus 200. Decoding apparatus 200 includes demultiplexing section 201, transform coding decoding section 202, CELP decoding section 203, MDCT section 204, CELP component suppressing section 205, adding section 206, and inverse modified discrete cosine transform (IMDCT) section 207. Each section performs the following operations.

In decoding apparatus 200 shown in FIG. 2, demultiplexing section 201 receives coded data including CELP coded data, transform-coded data, and CELP suppressing coefficient optimal index from coding apparatus 100 (FIG. 1) through a transmission path (not shown). Demultiplexing section 201 demultiplexes the coded data into the CELP coded data, the transform-coded data, and the CELP suppressing coefficient optimal index. Demultiplexing section 201 then outputs the CELP coded data to CELP decoding section 203, outputs the transform-coded data to transform coding decoding section 202, and outputs the CELP suppressing coefficient optimal index to CELP component suppressing section 205.

Transform coding decoding section 202 decodes the transform-coded data inputted from demultiplexing section 201 to generate a spectrum of a decoded signal subjected to transform coding and outputs the decoded transform-coded signal spectrum to adding section 206.

CELP decoding section 203 decodes the CELP coded data inputted from demultiplexing section 201 and outputs the CELP decoded signal to MDCT section 204.

MDCT section 204 performs a MDCT process on the CELP decoded signal inputted from CELP decoding section 203 to generate a CELP decoded signal spectrum. MDCT section 204 then outputs the generated CELP decoded signal spectrum to CELP component suppressing section 205.

CELP component suppressing section 205 includes a CELP suppressing coefficient code book that is similar to the CELP suppressing coefficient code book that CELP component suppressing section 104 includes. Although it is sufficient that the CELP suppressing coefficient code book that CELP component suppressing section 205 includes is basically the exact same as the CELP suppressing coefficient code book that CELP component suppressing section 104 includes, in a case in which suppressing is performed that includes some other kind of adjustment or the like, the aforementioned CELP suppressing coefficient code books need not necessarily be the same. CELP component suppressing section 205 multiplies each frequency component of the CELP decoded signal spectrum inputted from MDCT section 204 by the CELP suppressing coefficient corresponding to a CELP suppressing coefficient optimal index inputted from demultiplexing section 201, thereby calculating a CELP component suppressed spectrum in which the CELP decoded signal spectrum (CELP component) is suppressed. CELP component suppressing section 205 then outputs the calculated CELP component suppressed spectrum to adding section 206.

Adding section 206 adds the CELP component suppressed spectrum inputted from CELP component suppressing section 205 and the decoded transform-coded signal spectrum inputted from transform coding decoding section 202 to calculate a decoded signal spectrum, as with adding section 111 in coding apparatus 100. Adding section 206 then outputs the calculated decoded signal spectrum to IMDCT section 207.

IMDCT section 207 performs a MDCT process on the decoded signal spectrum inputted from adding section 206 and outputs the decoded signal.

Next, details of preliminary selection search process in coding apparatus 100 (FIG. 1) will be described.

First, an example of a method by which estimated pulse positions are estimated at pulse position estimating section 106 is described.

Generally, in transform coding, coding is performed such that pulses are generated at frequencies having a large amplitude of the input signal (in this case, the CELP residual signal spectrum). At this time, the number of pulses that are generated and a difference between the amplitudes of the pulses and the input signal differ according to a set bit rate or a frequency characteristic of the signal. Consequently, a coding distortion in transform coding can not be exactly determined without actually performing the coding. However, it is possible to estimate pulse positions to be encoded in transform coding by using statistical techniques.

In this case, it is assumed that a CELP residual signal spectrum has a normal distribution. It is also assumed that, in the transform coding, pulses are generated at frequencies that have larger amplitudes and that the pulse information is encoded. For example, it is assumed that pulses at the highest 10% of frequencies having a large amplitude in the CELP residual signal spectrum are encoded by coding apparatus 100, and coding apparatus 100 calculates a threshold value (amplitude threshold value) for determining pulse positions to be encoded by transform coding section 110.

Specifically, first, average absolute value Iavg[j] of the CELP residual signal spectrum is calculated in accordance with equation 1.

(Equation 1)

$$Iavg[j] = \sum_{i=1}^{N} |Cr[j][i]| / N \quad [1]$$

Here, Iavg[j] represents an average absolute value of the CELP residual signal spectrum with respect to CELP suppressing coefficient index j, i represents the number of a frequency sample, and Cr represents an amplitude of the CELP residual signal spectrum. Further, the total number of CELP suppressing coefficient indices is taken as M, and the total number of frequency samples is taken as N.

Next, standard deviation σ[j] of the CELP residual signal spectrum with respect to CELP suppressing coefficient index j is calculated in accordance with equation 2.

(Equation 2)

$$\sigma[j] = \sqrt{\left(\sum_{i=1}^{N} Cr[j][i]^2\right) \Big/ (N-1) - Iavg[j]^2} \quad [2]$$

Then, using average absolute value Iavg[j] calculated by equation 1 and standard deviation σ[j] calculated by equation 2, threshold value Ithr is calculated, for example, in accordance with equation 3.

(Equation 3)

$$Ithr[j] = Iavg[j] + \sigma[j] * \beta \quad [3]$$

Here, β is a constant that controls the value of threshold value Ithr. For example, when setting a threshold value so that the highest 10% of frequencies having a large amplitude in the CELP residual signal spectrum are selected, the value of β is set to approximately 1.6. Further, for example, when setting a threshold value so that the highest 5% of frequencies having a large amplitude in the CELP residual signal spectrum are selected, the value of β is set to approximately 2.0. The setting value of β can be determined according to a normal distribution table.

Pulse position estimating section 106 estimates a pulse position (estimated pulse position) to be encoded by transform coding section 110 by using threshold value Ithr shown in equation 3. More specifically, pulse position estimating section 106 estimates a pulse position to be encoded by transform coding section 110 with respect to CELP suppressing coefficient index j in accordance with equation 4.

(Equation 4)

$$Iep[j][i] = \begin{cases} 1.0 & \text{if } |Cr[j][i]| > Ithr[j] \quad (1 \le i \le N) \\ 0.0 & \text{otherwise} \quad (1 \le i \le N) \end{cases} \quad [4]$$

Here, Iep[j][i] indicates an estimated result regarding whether or not a pulse is generated at each frequency sample i (1≤i≤N) of CELP suppressing coefficient index j. In other words, as shown in equation 4, in CELP suppressing coefficient index j, Iep[j][i]=1.0 at a frequency sample i for which it is estimated that a pulse is generated, and Iep[j][i]=0.0 at the other frequency samples. That is, pulse position estimating section 106 takes a frequency sample for which Iep[j][i]=1.0 as an estimated pulse position.

In this manner, based on the distribution characteristics of the CELP residual signal spectrum (target signal), with only a low amount of computation, pulse position estimating section 106 efficiently estimates pulse positions to be obtained as a result of encoding in transform coding section 110. More specifically, pulse position estimating section 106 compares a threshold value (Ithr) that is calculated on the basis of a statistical quantity of amplitudes or a statistical quantity of absolute values of the amplitudes of the CELP residual signal spectrum (target signal), with an amplitude of the CELP residual signal spectrum, and estimates pulses (estimated pulse positions) to be encoded in transform coding section 110. Thus, it is sufficient to only judge between an amplitude and the threshold value in pulse position estimating section 106, and it is possible to identify pulse positions that are estimated to be encoded in transform coding section 110, with a smaller workload than a workload in transform coding section 110. Further, it is sufficient to include at least standard deviation σ as the aforementioned statistical quantity that is used in pulse position estimating section 106. By calculating a threshold value using a standard deviation that quantitatively represents the degree of variation in an amplitude or an absolute value of a target signal in this manner, it is possible to calculate a threshold value that provides high accuracy with respect to estimation of pulse positions with a small amount of computation.

Subsequently, estimated pulse attenuating section 107 attenuates the amplitude at estimated pulse positions (band corresponding to Iep[j][i]=1.0) that were estimated in pulse position estimating section 106, to thereby generate a transform coding estimated residual spectrum.

For example, in this case, for simplicity, it is assumed that, as the result of attenuation of the spectrum in estimated pulse attenuating section 107, a difference of a certain ratio remains with respect to the amplitude of the CELP residual signal spectrum at the estimated pulse positions (band corresponding to Iep[j][i]=1.0), and at the other pulse positions (band corresponding to Iep[j][i]=0.0) the CELP residual signal spectrum remains as a difference without change. More specifically, estimated pulse attenuating section 107 calculates transform coding estimated residual spectrum Cra in accordance with equation 5.

(Equation 5)

$$Cra[j][i] = \begin{cases} Cr[j][i]^{*}\alpha & \text{if } Iep[j][i] = 1.0 \quad (1 \le i \le N) \\ Cr[j][i] & \text{otherwise} \quad (1 \le i \le N) \end{cases} \qquad [5]$$

Here, α indicates to what extent the amplitude of the CELP residual signal spectrum remains as a difference at an estimated pulse position (that is, indicates the degree of attenuation), and represents a constant that is greater than or equal to 0 and less than 1 (hereinafter, referred to as "estimated residual coefficient"). For example, when a difference at an estimated pulse position is regarded as zero, α=0.0 is set, and when a difference of 10% is expected at an estimated pulse position, α=0.1 is set. In other words, estimated pulse attenuating section 107 calculates a transform coding estimated residual spectrum (that is, an estimated value of a decoded signal spectrum) by multiplying the amplitude of the CELP residual signal spectrum by the estimated residual coefficient (a value that is greater than or equal to 0 and less than 1). By estimating a difference due to transform coding by multiplying a constant that is greater than or equal to 0 and less than 1 by the CELP residual signal spectrum in this manner, a difference is calculated so that a predetermined SNR (Signal Noise Ratio) is acquired by transform coding. The SNR at this time is represented by equation 6.

(Equation 6)

$$\text{SNR} = -20 \cdot \log_{10}\alpha \qquad [6]$$

Next, in accordance with equation 7, using the input signal spectrum and the transform coding estimated residual spectrum, estimated distortion evaluating section 108 calculates estimated distortion energy Ee that is an estimated value of a coding distortion (distortion energy) due to transform coding (hereinafter, may be referred to as "estimated distortion evaluation").

(Equation 7)

$$Ee[j] = \theta[j] * \left( \sum_{i=1}^{N} (Cra[j][i] * Cra[j][i]) \Big/ \sum_{i=1}^{N} S[i]^2 \right) \qquad [7]$$

Here, S represents an input signal spectrum. Further, θ represents a fixed value that is set for each CELP suppressing coefficient, and has a function of adjusting an estimated distortion energy between CELP suppressing coefficients. For example, when a CELP suppressing coefficient (index j) is zero, θ[j]=1.0 is set, and as the CELP suppressing coefficient (index j) increases, an adjustment is made so as to approach θ[j]=0.0.

Thus, estimated distortion evaluating section 108 calculates an estimated distortion energy with respect to a transform coding estimated residual spectrum for which the amplitude of the spectrum at estimated pulse positions has been attenuated using a ratio that is greater than or equal to 0 and less than 1. Thus, in estimated distortion evaluating section 108, an estimated distortion energy at pulse positions that are estimated to be encoded in transform coding section 110 can be estimated by means of a smaller workload than a workload in transform coding section 110.

Note that, in the preliminary selection search, when performing an estimated distortion evaluation using all CELP suppressing coefficients, estimated distortion evaluating section 108 operates so as to scan all of the CELP suppressing coefficient indices. In other words, estimated distortion evaluating section 108 outputs all of the CELP suppressing coefficient indices to CELP component suppressing section 104. On the other hand, in the preliminary selection search, it is also possible to limit the CELP suppressing coefficient candidates on which to perform an estimated distortion evaluation.

For example, a case will be described in which a preliminary selection search is performed for only three candidates when the total number of CELP suppressing coefficient indices is M=4. At this time, candidates are limited by excluding either of a coefficient that suppresses most strongly and a coefficient that suppresses most weakly from the main selection search. First, estimated distortion energies are calculated with respect to CELP suppressing coefficient indices j=1 and j=4 (that is, Ee[1] and Ee[4]). Next, if Ee[1] is less than Ee[4], estimated distortion evaluating section 108 calculates an estimated distortion energy (that is, Ee[2]) corresponding to CELP suppressing coefficient index j=2, and if Ee[4] is less than Ee[1], estimated distortion evaluating section 108 calculates an estimated distortion energy (that is, Ee[3]) corresponding to CELP suppressing coefficient index j=3. In other words, an estimated distortion evaluation is performed that is limited to three kinds of CELP suppressing coefficients for j=1, 4, and either one of 2 and 3 to thereby complete the preliminary selection search. Hence, estimated distortion evaluating section 108 only needs to perform an estimated distortion evaluation for three CELP suppressing coefficients, and thus the workload required for the preliminary selection search can be suppressed to approximately ¾ of the workload required for evaluating all four of the CELP suppressing coefficients for j=1 to 4.

Next, based on the distribution of the estimated distortion energy, main selection candidate limiting section 109 limits the CELP suppressing coefficient candidates (CELP suppressing coefficients to be used in transform coding) that are search targets in the main selection search. That is, based on the estimated distortion energy, main selection candidate limiting section 109 preliminarily selects a predetermined number of CELP suppressing coefficients among a plurality of CELP suppressing coefficients stored in the CELP suppressing coefficient code book. Hereunder, limitation methods 1 and 2 for the main selection search at main selection candidate limiting section 109 are described. Hereunder, as one example, a case is described in which M=4 (j=1 to 4).

<Method 1>

According to method 1, a preliminary selection search is performed with respect to the largest coefficient and the smallest coefficient of the CELP suppressing coefficients, it is determined that the possibility of the CELP suppressing coefficient for which the estimated distortion energy is larger being selected in the main selection search is small, and therefore the CELP suppressing coefficient in question is excluded from the main selection search to thereby reduce the workload in the main selection search.

The above method is implemented as follows. First, estimated distortion energies for CELP suppressing coefficient indices j=1 and j=4 (that is, Ee[1] and Ee[4]) are inputted to main selection candidate limiting section 109.

(1) Main selection candidate limiting section 109 compares Ee[1] and Ee[4].

(2) If Ee[1] is less than Ee[4], main selection candidate limiting section 109 limits the main selection search to the three kinds of CELP suppressing coefficients for j=1, 2, 3. In contrast, if Ee[4] is less than Ee[1], main selection candidate limiting section 109 limits the main selection search to the three kinds of CELP suppressing coefficients for j=2, 3, 4.

The main selection search uses the three CELP suppressing coefficients (CELP suppressing coefficient indices) for limiting the main selection search in this manner.

That is, among the plurality of CELP suppressing coefficients that are stored in CELP component suppressing section 104, main selection candidate limiting section 109 compares an estimated distortion energy when a maximum value is used and an estimated distortion energy when a minimum value is used (in the above example, compares the smallest index j=1 and the largest index j=4), and excludes a CELP suppressing coefficient for which the estimated distortion energy is larger from the targets of the main selection search (CELP suppressing coefficients group of main selection search). That is, by performing a preliminary selection search, the search target candidates for the main selection search are reduced by one.

At this time, in coding apparatus 100, the number of computations in the preliminary selection search (number of estimated distortion evaluations) is two (in the above example, two times for j=1 and 4), and the number of computations in the main selection search is three (j=1, 2 and 3, or j=2, 3, and 4). At this time, if the workload for a single computation (the decreased amount) of transform coding in the main selection search is greater than a workload for two computations in the preliminary selection search, the overall workload of coding apparatus 100 is reduced.

Thus, according to method 1, a preliminary selection search is performed for only the required minimum CELP suppressing coefficients (in this case, two CELP suppressing coefficients that are a maximum value and a minimum value). Further, in method 1, the CELP suppressing coefficient for which the estimated distortion energy is larger is excluded from the targets of the main selection search. Thus, compared to when performing a search with respect to all CELP suppressing coefficients in the main selection search, the workload in coding apparatus 100 can be reduced while suppressing a deterioration in the quality of encoding.

<Method 2>

According to method 2, a preliminary selection search is performed using all CELP suppressing coefficients, and the workload of the main selection search is decreased by limiting the main selection search to CELP suppressing coefficients which have a high possibility of being selected in the main selection search also based on the estimated distortion energy. At this time, a candidate for which the estimated distortion energy is lowest is always left as a candidate for the main selection search. Further, (one of or both of) the CELP suppressing coefficients of indices that are next to a CELP suppressing coefficient index assigned to the candidate that is left are also left as a candidate for the main selection search. This is because, when CELP suppressing coefficient indices are arranged in ascending or descending order with respect to the degree of suppressing, the possibility of these CELP suppressing coefficient candidates being selected as a candidate with respect to which the distortion energy is smallest at the time of the main selection search is higher than that of CELP suppressing coefficient candidates other than the candidate with respect to which the estimated distortion energy is smallest and the candidates that are next to that candidate.

A case where two kinds of CELP suppressing coefficients are taken as search targets in the main selection search will now be described as a method that performs the above described process.

The estimated distortion energies (that is, Ee[1] to Ee[4]) for all the CELP suppressing coefficients (j=1 to 4) are inputted into main selection candidate limiting section 109.

(1) Main selection candidate limiting section 109 searches for the smallest estimated distortion energy among the estimated distortion energies Ee[1] to Ee[4], and stores the CELP suppressing coefficient index corresponding to the smallest estimated distortion energy.

(2) Main selection candidate limiting section 109 compares the estimated distortion energies corresponding to CELP suppressing coefficient indices that are before and after (at both ends of) the stored CELP suppressing coefficient index (that is, the CELP suppressing coefficient index corresponding to the smallest estimated distortion energy), and stores the CELP suppressing coefficient index with respect to which the estimated distortion energy is smaller.

(3) Main selection candidate limiting section 109 limits the CELP suppressing coefficients group for the main selection search to two kinds of CELP suppressing coefficients, namely, the CELP suppressing coefficient index stored in the processing of (1) (that is, the CELP suppressing coefficient index corresponding to the smallest estimated distortion energy), and the CELP suppressing coefficient index stored in the processing of (2).

The two CELP suppressing coefficients (CELP suppressing coefficient indices) to which the CELP suppressing coefficients group has been limited in this manner are used in the main selection search.

That is, among the plurality of CELP suppressing coefficients stored in CELP component suppressing section 104, main selection candidate limiting section 109 specifies a CELP suppressing coefficient with respect to which the estimated distortion energy is smallest (first CELP suppressing coefficient) and a CELP suppressing coefficient (second CELP suppressing coefficient) with respect to which the estimated distortion energy is smaller among the CELP suppressing coefficients corresponding to the CELP suppressing coefficient indices before and after the CELP suppressing coefficient with respect to which the estimated distortion energy is smallest, as targets of the main selection search. In other words, as a predetermined number of CELP suppressing coefficients, main selection candidate limiting section 109 preliminarily selects a CELP suppressing coefficient (first CELP suppressing coefficient) with respect to which the estimated distortion energy is smallest among the plurality of CELP suppressing coefficients, and a CELP suppressing coefficient (second CELP suppressing coefficient) with respect to which the estimated distortion energy is smaller among two CELP suppressing coefficients corresponding to CELP suppressing coefficient indices before and after a CELP suppressing coefficient index assigned to the CELP suppressing coefficient with respect to which the estimated distortion energy is smallest.

At this time, in coding apparatus 100, the number of computations (number of estimated distortion evaluations) is four (j=1 to 4) in the preliminary selection search, and the number of computations in the main selection search is two. In this case, if the workload for two (decreased amount) transform coding operations in the main selection search is greater than the workload for four computations in the preliminary selection search, the overall workload of coding apparatus 100 is reduced. In other words, similarly to method 1, if the workload for one transform coding operation in the main selection search is greater than a workload for two computations in the preliminary selection search, the overall workload of coding apparatus 100 is reduced.

Thus, according to method 2, although a preliminary selection search is performed that takes all CELP suppressing coefficients as targets, the CELP suppressing coefficients group that is the target of the main selection search is limited to a narrower group in comparison to in method 1. It is thereby possible to reduce the workload in the main selection search more than in method 1.

Also, according to method 2, a CELP suppressing coefficient with respect to which the estimated distortion energy is smallest and a CELP suppressing coefficient with respect to which the estimated distortion energy is smaller among CELP suppressing coefficients corresponding to CELP suppressing coefficient indices at both ends of the aforementioned CELP suppressing coefficient are the targets of the main selection search. That is, in the preliminary selection search, CELP suppressing coefficients which have a high possibility of being determined as an optimal CELP suppressing coefficient (CELP suppressing coefficient with respect to which the distortion energy is smallest) in the main selection search are searched for. Hence, according to method 2, in comparison to a case of performing a search with respect to all CELP suppressing coefficients in the main selection search, the workload in coding apparatus 100 can be reduced while suppressing a deterioration in the quality of encoding.

Note that, in method 2, main selection candidate limiting section 109 may also specify a CELP suppressing coefficient with respect to which the estimated distortion energy is smallest (for example, CELP suppressing coefficient index j) among a plurality of CELP suppressing coefficients stored in CELP component suppressing section 104 and a CELP suppressing coefficients group (for example, CELP suppressing coefficient indices [j−1] and [j+1]) corresponding to CELP suppressing coefficient indices before and after the CELP suppressing coefficient with respect to which the estimated distortion energy is smallest as targets of the main selection search. In other words, main selection candidate limiting section 109 may also preliminarily select a CELP suppressing coefficient with respect to which the estimated distortion energy is smallest among a plurality of CELP suppressing coefficients and two CELP suppressing coefficients corresponding to indices before and after an index assigned to the CELP suppressing coefficient with respect to which the estimated distortion energy is smallest as the predetermined number of CELP suppressing coefficients.

In the foregoing, methods 1 and 2 for limiting a CELP suppressing coefficients group that serves as a target of the main selection search at main selection candidate limiting section 109 are described. As described above, according to method 1, by broadening the range of targets of the main selection search in comparison to method 2, it is possible to further reduce a degradation in the performance of the main selection search that is caused by limiting the targets of the main selection search. On the other hand, according to method 2, the workload in the main selection search can be decreased further compared to method 1.

Thus, in coding apparatus 100, in the preliminary selection search, estimated distortion evaluating section 108 outputs CELP suppressing coefficient indices that are taken as search targets in the preliminary selection search to CELP component suppressing section 104. As a result, a transform coding estimated residual spectrum for each CELP suppressing coefficient index is inputted to estimated distortion evaluating section 108, and estimated distortion evaluating section 108 calculates an estimated distortion energy corresponding to each CELP suppressing coefficient index. Further, main selection candidate limiting section 109 limits the CELP suppressing coefficient indices that are to be taken as search targets in the main selection search for actually performing a distortion evaluation using transform coding, based on the estimated distortion energy. In other words, in coding apparatus 100, in the preliminary selection search, CELP suppressing coefficients with respect to which it is expected (estimated) that the distortion energy due to transform coding will be smaller in the main selection search are specified.

Next, in coding apparatus 100, in the main selection search, transform coding section 110 performs transform coding using only the CELP suppressing coefficient indices group that is specified by main selection candidate limiting section 109, and distortion evaluating section 112 performs a search for a CELP suppressing coefficient with respect to which the distortion energy is smallest. A CELP suppressing coefficient index corresponding to the CELP suppressing coefficient with respect to which the distortion energy is smallest is then outputted to multiplexing section 113, and the relevant CELP suppressing coefficient index is transmitted to decoding apparatus 200 as one part of coded data of coding apparatus 100.

That is, according to the present embodiment, coding apparatus 100 statistically estimates pulse positions to be encoded by transform coding, calculates estimated distortion energies that are estimated at the estimated pulse positions, and limits a CELP suppressing coefficients group that is a target of a main selection search to CELP suppressing coefficients with respect to which the estimated distortion energy is smaller (preliminary selection search). Subsequently, coding apparatus 100 performs transform coding on each of the CELP suppressing coefficients that remain after limiting the candidates in the preliminary selection search, and determines a CELP suppressing coefficient with respect to which the energy (distortion energy) of a residual signal is smallest (main selection search).

Thus, only CELP suppressing coefficients with respect to which the distortion energy is expected to be small are taken as targets for the main selection search in the preliminary selection search, and hence the number of times of performing transform coding is reduced in coding apparatus 100. In this case, as described above, in the preliminary selection search, it is possible for the estimating of pulse positions in pulse position estimating section 106, the calculating of a transform coding estimated residual spectrum in estimated pulse attenuating section 107, and the calculating of a distortion energy in estimated distortion evaluating section 108 to be performed with a smaller workload than when performing the corresponding processing in transform coding section 110. Hence, by limiting a CELP suppressing coefficients group that is to be the target of the main selection search in advance in the preliminary selection search, the workload in coding apparatus 100 can be reduced in comparison to when performing transform coding successively for all CELP suppressing coefficients.

In addition, the preliminary selection search limits the candidates as targets for the main selection search to only CELP suppressing coefficients corresponding to the estimated distortion energy expected to be small, i.e., to only CELP suppressing coefficients having a high possibility that the corresponding distortion energy will be evaluated as the smallest in the main selection search. This can suppress a deterioration in the quality of encoding caused by limiting the CELP suppressing coefficients group that is taken as a target of the main selection search.

Hence, according to the present embodiment, in a coding method which combines coding suitable for a speech signal with coding suitable for a music signal in a layer structure, in comparison to a method that successively performs transform coding with respect to all CELP suppressing coefficient candidates, a workload at a coding apparatus can be reduced while suppressing a deterioration in the quality of encoding.

Note that, in the present embodiment, with respect to values that are also used when performing the main selection search (for example, a CELP residual signal spectrum or the like) among the values calculated at the time of the preliminary selection search, the values calculated at the time of the preliminary selection search may be utilized without being recalculated at the time of the main selection search. Thus, in the coding apparatus, the workload at the time of the main selection search can be further reduced.

(Embodiment 2)

Figure 3:
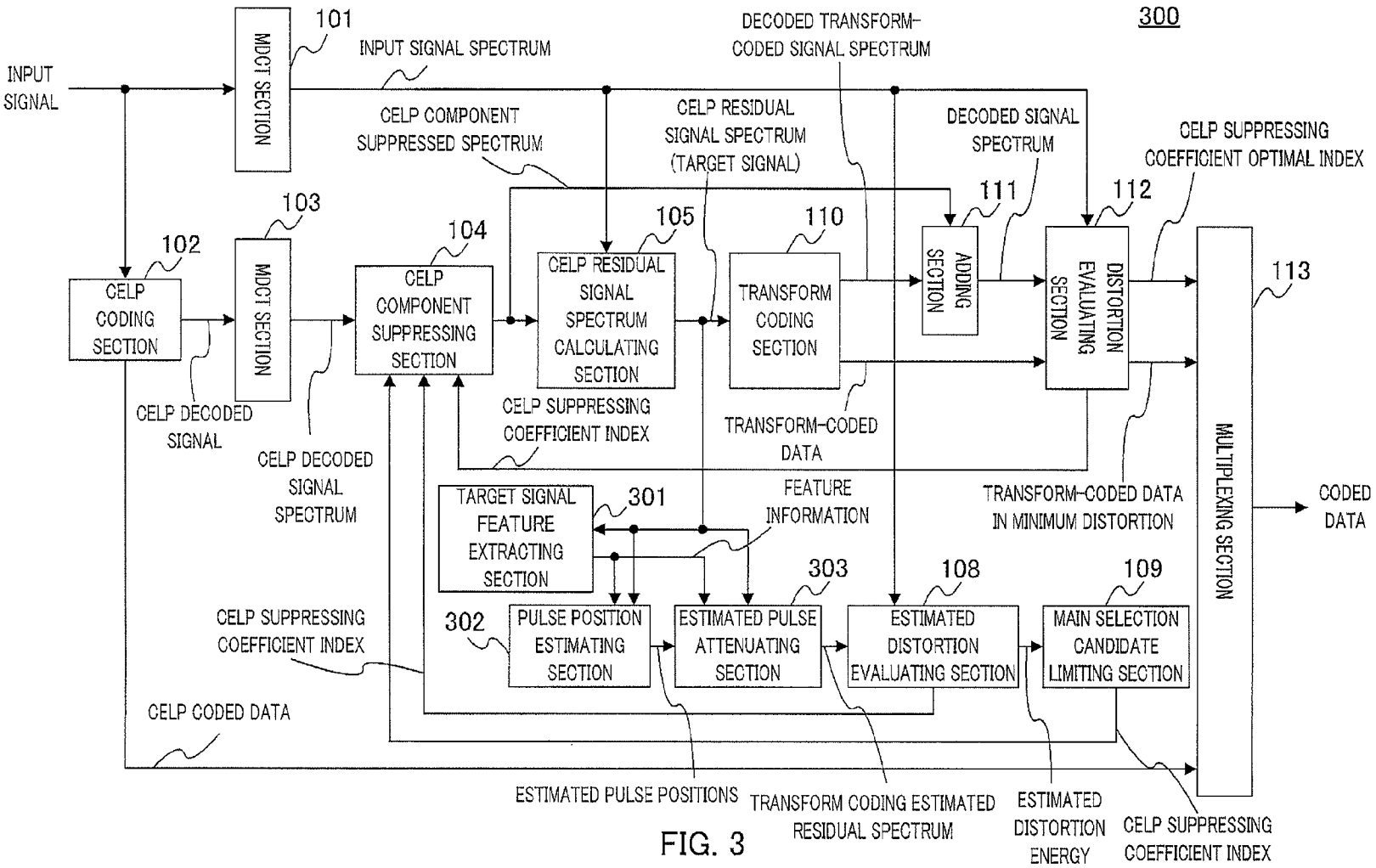
FIG. 3 is a block diagram showing a configuration of a coding apparatus according to Embodiment 2 of the present invention.

FIG. 3 is a block diagram showing a main configuration of coding apparatus 300 according to Embodiment 2 of the present invention. In FIG. 3, the same components as in Embodiment 1 (FIG. 1) are assigned the same reference numerals and descriptions will be omitted. Coding apparatus 300 shown in FIG. 3 differs from coding apparatus 100 shown in FIG. 1 in that target signal feature extracting section 301 is added to coding apparatus 100. Further, the fact that feature information that is outputted from target signal feature extracting section 301 is added as an input signal to pulse position estimating section 302 and estimated pulse attenuating section 303 is different from Embodiment 1.

In coding apparatus 300 shown in FIG. 3, target signal feature extracting section 301 extracts a feature of the relevant target signal using a CELP residual signal spectrum (target signal) that is inputted from CELP residual signal spectrum calculating section 105.

Here, as one example, a case in which FPC (Factorial Pulse Coding) is used as transform coding will be described. In FPC, there is a characteristic that the number of pulses that can be encoded increases when variations in the amplitude of a spectrum that is the target of encoding (here, a CELP residual signal spectrum) are small, and the number of pulses that can be encoded decreases when variations in the amplitude of the spectrum that is the target of encoding are large. For example, in a target signal in which energy is concentrated in a certain band, the number of pulses encoded by FPC decreases while in a target signal in which energy is dispersed over all the bands, the number of pulses encoded by FPC increases.

In other words, in coding apparatus 300, the above described feature of a target signal (CELP residual signal spectrum) is extracted, and the number of pulses to be encoded by FPC can be predicted based on the extracted feature. That is, in the preliminary selection search, is possible to accurately estimate pulse positions of a target signal.

According to the present embodiment, target signal feature extracting section 301 extracts a ratio between an average value of amplitudes of a target signal and a maximum value of the amplitudes as a feature of the target signal. More specifically, target signal feature extracting section 301 calculates average value Iavg of the amplitudes of the target signal in accordance with equation 1. Further, target signal feature extracting section 301 takes a maximum value of absolute value amplitudes of the target signal as tmax. Here, the larger the value of tmax/Iavg is, the higher the possibility is that energy is concentrated in a certain specific band. That is, the larger the value of tmax/Iavg is, the higher the possibility is that there are large variations in the spectrum.

Hence, for a larger value of tmax/Iavg, target signal feature extracting section 301 determines to reduce the number of pulses of the target signal estimated in the preliminary selection search. On the other hand, since a smaller value of tmax/Iavg results in a higher possibility that energy is dispersed over all the bands, target signal feature extracting section 301 determines to increase the number of pulses of the target signal estimated in the preliminary selection search. Therefore, in accordance with the value of tmax/Iavg, target signal feature extracting section 301 generates information relating to the number of pulses of the target signal that is predicted on the basis of the feature of the target signal as feature information K in accordance with equation 8.

(Equation 8)

$$K = \begin{cases} 1.1 & t\max/Iavg > \kappa h \\ 0.9 & t\max/Iavg < \kappa l \\ 1.0 & \text{otherwise} \end{cases} \quad [8]$$

Here, κh is a preset threshold value for determining whether or not to decrease the number of pulses that are estimated in the preliminary selection search (pulse position estimating section 302), and κ1 is a preset threshold value for determining whether or not to increase the number of pulses that are estimated in the preliminary selection search.

Pulse position estimating section 302 estimates pulse positions (estimated pulse positions) to be encoded by transform coding section 110 using the CELP residual signal spectrum (target signal) inputted from CELP residual signal spectrum calculating section 105 and feature information K inputted from target signal feature extracting section 301. More specifically, pulse position estimating section 302 uses threshold value Ithr[j] shown in equation 9 instead of equation 3 that is used in Embodiment 1 (pulse position estimating section 106).

(Equation 9)

$$Ithr[j]=Iavg[j]+\sigma[j]*\beta*K \quad [9]$$

That is, in equation 9, the value of β is adaptively corrected for each frame depending on the value of feature information K (0.9, 1.0, 1.1), to thereby adaptively control the number of pulses selected in pulse position estimating section 302. In other words, as shown in equation 9, pulse position estimating section 302 corrects Embodiment 1 (equation 3) using feature information K inputted from target signal feature extracting section 301.

Therefore, in pulse position estimating section 302, when there is a high possibility that energy is concentrated in a certain specific band in the target signal (when tmax/Iavg>κh in equation 8), since feature information K=1.1, "β" becomes "β*1.1" and threshold value Ithr[j] is controlled so as to increase. Hence, in pulse position estimating section 302, the number of pulses that exceed threshold value Ithr[j] decreases.

On the other hand, in pulse position estimating section 302, when there is a high possibility that energy is dispersed over all bands of the target signal (when tmax/Iavg<κ1 in equation 8), since feature information K=0.9, "β" becomes "β*0.9" and threshold value Ithr[j] is controlled so as to decrease. Hence, in pulse position estimating section 302, the number of pulses that exceed threshold value Ithr[j] increases.

In other words, when tmax/Iavg>κh in equation 8 (when variations in the spectrum are large), pulse position estimating section 302 sets the estimated number of pulses to a low value, while when tmax/Iavg<κ1 in equation 8 (when variations in the spectrum are small), pulse position estimating section 302 sets the estimated number of pulses to a high value. That is, pulse position estimating section 302 sets the estimated number of pulses in accordance with the feature of the CELP residual signal spectrum, and estimates the positions of the number of pulses that are set. For example, pulse position estimating section 302 sets the number of pulses so as to decrease as variations in the amplitudes of the respective bands of the CELP residual signal spectrum increase.

Estimated pulse attenuating section 303 uses the feature information inputted from target signal feature extracting section 301 to attenuate the spectrum at estimated pulse positions that are inputted from pulse position estimating section 302 in the CELP residual signal spectrum that is inputted from CELP residual signal spectrum calculating section 105.

More specifically, estimated pulse attenuating section 303 calculates transform coding estimated residual spectrum Cra in accordance with equation 10, instead of equation 5 that is used in Embodiment 1 (estimated pulse attenuating section 107).

(Equation 10)

$$Cra[j][i] = \begin{cases} Cr[j][i] * (\alpha / K) & \text{if } Iep[j][i] = 1.0 \quad (1 \le i \le N) \\ Cr[j][i] & \text{otherwise} \quad (1 \le i \le N) \end{cases} \quad [10]$$

That is, in equation 10, the value of estimated residual count α is adaptively corrected for each frame depending on the value of feature information K (0.9, 1.0, 1.1), to thereby adaptively control the degree of attenuation (estimated difference amount) in estimated pulse attenuating section 303. In other words, as shown in equation 10, estimated pulse attenuating section 303 corrects Embodiment 1 (equation 5) using feature information K inputted from target signal feature extracting section 301.

Thereby, in estimated pulse attenuating section 303, when there is a high possibility that energy is concentrated in a certain specific band in the target signal (when tmax/Iavg>κh in equation 8), since feature information K=1.1, "α" becomes "α/1.1" and a difference at the estimated pulse position is controlled so as to decrease further. On the other hand, in estimated pulse attenuating section 303, when there is a high possibility that energy is dispersed over all bands of the target signal (when tmax/Iavg<κ1 in equation 8), since feature information K=0.9, "α" becomes "α/0.9" and a difference at the estimated pulse position is controlled so as to increase further.

In other words, when tmax/Iavg>κh in equation 8 (when variations in the amplitude of the spectrum are large), estimated pulse attenuating section 303 increases the degree of attenuation of the spectrum, while when tmax/Iavg<κ1 in equation 8 (when variations in the amplitude of the spectrum are small), estimated pulse attenuating section 303 decreases the degree of attenuation of the spectrum. That is, estimated pulse attenuating section 303 sets the degree of attenuation of the CELP residual signal spectrum so as to increase as variations in the amplitude of respective bands of the CELP residual signal spectrum increase.

In other words, an SNR that is calculated according to an estimated value of a difference in transform coding is adaptively changed depending on variations in an amplitude of the spectrum. The SNR at this time is represented by equation 11.

(Equation 11)

$$SNR = -20 \cdot \log_{10}(\alpha / K) \quad [11]$$

In this manner, coding apparatus 300 adaptively controls the number of pulses that are encoded in transform coding section 110 and a difference of the pulses (degree of attenuation in estimated pulse attenuating section 303) in accordance with a feature (in this case, a variation (tmax/Iavg) in an amplitude of a spectrum) of a target signal (CELP residual signal spectrum). As a result, in coding apparatus 300, a distortion energy at a pulse position estimated to undergo encoding in transform coding section 110 can be estimated more accurately than in Embodiment 1. Further, similarly to Embodiment 1, in coding apparatus 300, the estimating of estimated pulse positions, the calculating of a transform coding estimated residual spectrum in estimated pulse attenuating section 107, and the calculating of distortion energies in estimated distortion evaluating section 108 can be performed with a smaller workload than when performing the corresponding processing in transform coding section 110.

Hence, according to the present embodiment, in a coding method which combines coding suitable for a speech signal with coding suitable for a music signal in a layer structure, relative to Embodiment 1, it is possible to reduce a workload at a coding apparatus when compared to a method that successively performs transform coding with respect to all CELP suppressing coefficient candidates, while further suppressing a deterioration in the quality of encoding.

Note that, although according to the present embodiment, a case is described in which a variation in an amplitude of a spectrum is used as a feature of a target signal, the present invention is not limited to a case where a variation in an amplitude of a spectrum is used as a feature of a target signal. For example, a tone feature of a target signal may also be used as a feature of a target signal. As used herein, the term "tone feature" refers to an indicator that shows a size of a peak of a spectrum or a size of a dynamic range. For example, it is possible to measure a ratio of the geometric mean to the arithmetic mean of a target signal or an absolute value thereof, and determine that the tone feature is high if the ratio is close to 0. More specifically, in coding apparatus 300 shown in FIG. 3, target signal feature extracting section 301 measures a tone feature of a target signal. Further, pulse position estimating section 302 sets the number of pulses so as to decrease as the tone feature increases. For example, it is sufficient for pulse position estimating section 302 to set a threshold value to a large value when the tone feature of the target signal is high, to thereby perform control to decrease the estimated number of pulses, and to set the threshold value to a small value when the tone feature of the target signal is low, to thereby perform control to increase the estimated number of pulses. Further, estimated pulse attenuating section 303 sets the degree of attenuation of the CELP residual signal spectrum so as to increase as the tone feature increases. That is, it is sufficient for estimated pulse attenuating section 303 to perform control so as to decrease an estimated residual coefficient (increase the degree of attenuation) and thereby reduce a residual signal (difference) when a tone feature of the target signal is high, and to perform control so as to increase an estimated residual coefficient (decrease the degree of attenuation) and thereby increase a residual signal (difference) when a tone feature of the target signal is low. Thus, even when using a tone feature as the feature of the target signal, the same effect as that of the present embodiment can be obtained.

Further, for example, a noise feature of a target signal may also be used as a feature of the target signal. As used herein, the term "noise feature" refers to an indicator that shows the smallness of a bias of energy of a target signal. For example, it is possible to divide a target signal into a number of bands and measure the energy for each band, and determine that a noise feature is high when there is a small degree of dispersion with respect to the energy for each band. More specifically, in coding apparatus 300 shown in FIG. 3, target signal feature extracting section 301 measures a noise feature of the target signal. Subsequently, pulse position estimating section 302 makes a setting so that the number of pulses increases as the noise feature increases. For example, it is sufficient for pulse position estimating section 302 to set the threshold value to a small value when the noise feature of the target signal is high to thereby perform control to increase the estimated number of pulses, and to set the threshold value to a large value when the noise feature of the target signal is low to thereby perform control to reduce the estimated number of pulses. Further, estimated pulse attenuating section 303 makes a setting so that the degree of attenuation of the CELP residual signal spectrum decreases as the noise feature increases. That is, it is sufficient for estimated pulse attenuating section 303 to perform control so as to increase an estimated residual coefficient (decrease the degree of attenuation) and thereby increase a residual signal (difference) when the noise feature of the target signal is high, and to perform control so as to decrease an estimated residual coefficient (increase the degree of attenuation) and thereby decrease a residual signal (difference) when the noise feature of the target signal is low. Thus, even when using a noise feature as a feature of a target signal, the same effect as that of the present embodiment can be obtained.

Embodiments of the present invention have been described above.

In the above embodiments, a case has been described in which it is assumed that, in the pulse position estimating section, a signal (CELP residual signal spectrum) that is input to the transform coding section has a normal distribution, and a threshold value (Ithr) is set for selecting frequencies having a larger amplitude. However, when it can be assumed that a signal (CELP residual signal spectrum) that is input to the transform coding section has a distribution other than a normal distribution, the pulse position estimating section may set the threshold value (Ithr) in accordance with the relevant distribution model.

Further, according to the above embodiments, a case may arise in which the pulse position estimating section estimates the number of pulses that exceeds an upper limit of the number of pulses to be encoded at the transform coding section. In this respect, the pulse position estimating section may control the number of pulses that is estimated, by using the relevant upper limit. At this time, the pulse position estimating section may exclude pulses that have smaller amplitudes or may exclude pulses on a higher band side. Alternatively, in addition to the above-described amplitude and frequency band conditions, the pulse position estimating section may link other conditions that can be calculated on the basis of a feature of a signal to determine the pulses to be excluded.

Further, in the above embodiments, a case has been described where CELP suppressing coefficients are stored in a CELP suppressing coefficient code book in an ascending or descending order of the degree of CELP suppressing. However, when using a method independent of the order of the storing, as a method of limiting suppressing coefficient candidates, the CELP suppressing coefficients need not necessarily be stored in an ascending or descending order.

The above embodiments employ CELP coding as an example of coding suitable for a speech signal, but the present invention can be implemented using, for example, ADPCM (Adaptive Differential Pulse Code Modulation), APC (Adaptive Prediction Coding), ATC (Adaptive Transform Coding), and TCX (Transform Coded Excitation), and the same effect can be acquired.

A case has been described where the transform coding is employed as an example of coding suitable for a music signal in the above embodiments, but a method may be also applicable which can efficiently encode a residual signal between an input signal and a decoded signal in a coding method suitable for a speech signal in the frequency domain. Such a method includes FPC (Factorial Pulse Coding) and AVQ (Algebraic Vector Quantization), and the same effect can be acquired.

In the above embodiments, decoding apparatus 200 receive coded data outputted from coding apparatus 100 and 300, but the present invention is not limited thereto. In other words, decoding apparatus 200 can decode any coded data outputted from a coding apparatus capable of generating coded data including coded data necessary for decoding, instead of coded data generated in the configuration of coding apparatus 100 and 300.

Although a case has been described with each embodiment as an example where the present invention is implemented with hardware, the present invention can be implemented with software in collaboration with hardware.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be regenerated is also possible.

Further, if integrated circuit technology comes out to replace LSI's as a result of the advancement of semiconductor technology or a derivative other technology, it is naturally also possible to carry out function block integration through this technology. Application of biotechnology is also possible.

The disclosure of Japanese Patent Application No. 2010-203657, filed on Sep. 10, 2010, including the specification, drawings and abstract, is incorporated herein by reference in its entirety.

INDUSTRIAL APPLICABILITY

The present invention can prevent deterioration of quality of encoding and reduce amount of computation as an entire apparatus, and may be applicable to a packet communication system, a mobile communication system, and so forth.

REFERENCE SIGNS LIST

100, 300 Coding apparatus
200 Decoding apparatus
101, 103, 204 MDCT section
102 CELP coding section
104, 205 CELP component suppressing section
105 CELP residual signal spectrum calculating section
106, 302 Pulse position estimating section
107, 303 Estimated pulse attenuating section
108 Estimated distortion evaluating section
109 Main selection candidate limiting section
110 Transform coding section
111, 206 Adding section
112 Distortion evaluating section
113 Multiplexing section
201 Demultiplexing section
202 Transform coding decoding section
203 CELP decoding section
207 IMDCT section
301 Target signal feature extracting section

The invention claimed is:

1. A coding apparatus, comprising:

a memory; and a processor, which performs the functions of a first coding section that outputs a spectrum of a first decoded signal that is generated by decoding a first code obtained by a first encoding of an input audio signal;

a suppressing section that suppresses an amplitude of the spectrum of the first decoded signal using a specified suppressing coefficient that is specified by a preliminary selector from among a plurality of suppressing coefficients, to generate a suppressed spectrum;

a residual spectrum calculating section that calculates a residual spectrum with respect to the specified suppressing coefficient using a spectrum of the input audio signal and the suppressed spectrum;

a preliminary selecting section that specifies the specified suppressing coefficients to the suppressing section from among a plurality of suppressing coefficients and selects a predetermined number of suppressing coefficients from among the specified suppressing coefficients using the spectrum of the input audio signal and the residual spectrum; and a second coding section that encodes the specified suppressing coefficient using a residual spectrum with respect to each of the predetermined number of suppressing coefficients, and determines one suppressing coefficient with respect to which a coding distortion caused by the second encoding is smallest, among the predetermined number of suppressing coefficients using a spectrum of a second decoded signal that is generated by decoding a second code obtained by the second encoding, the suppressed spectrum and the spectrum of the input audio signal, wherein the preliminary selecting section further comprises an estimating section that estimates a position of a pulse that is generated with respect to the residual spectrum in the second encoding, using the residual spectrum;

an attenuating section that generates an estimated residual spectrum by attenuating an amplitude at the estimated position of the pulse in the residual spectrum;

a calculating section that calculates an estimated distortion energy that is an estimated energy of the coding distortion, using the estimated residual spectrum and the spectrum of the input audio signal; and a candidate limiting section that preliminarily selects the predetermined number of suppressing coefficients among the plurality of suppressing coefficients based on the estimated distortion energy;

wherein the attenuating section attenuates an amplitude of the spectrum at the estimated position of the pulse by multiplying the amplitude by a coefficient having a value that is greater than or equal to 0 and less than 1 and wherein the coding apparatus achieves higher processing efficiency and encoding quality by processing separate portions of the input audio signal using different coding.

2. The coding apparatus according to claim 1, wherein indices are assigned to the plurality of suppressing coefficients in an ascending or descending order with respect to a degree of suppressing; and wherein as the predetermined number of suppressing coefficients, the candidate limiting section preliminarily selects a suppressing coefficient with respect to which the estimated distortion energy is smallest among the plurality of suppressing coefficients, and two suppressing coefficients that correspond to indices before and after an index assigned to the suppressing coefficient with respect to which the estimated distortion energy is smallest.

3. The coding apparatus according to claim 1, wherein indices are assigned to the plurality of suppressing coefficients in an ascending or descending order with respect to a degree of suppressing; and wherein as the predetermined number of suppressing coefficients, the candidate limiting section preliminarily selects a first suppressing coefficient with respect to which the estimated distortion energy is smallest among the plurality of suppressing coefficients, and a second suppressing coefficient with respect to which the estimated distortion energy is smaller among two suppressing coefficients that correspond to indices before and after an index assigned to the first suppressing coefficient.

4. The coding apparatus according to claim 1, wherein the estimating section estimates a position of the pulse by comparing a threshold value that is calculated based on a statistical quantity of an amplitude of the residual spectrum, and an amplitude of the residual spectrum.

5. The coding apparatus according to claim 4, wherein the statistical quantity includes at least a standard deviation of the amplitude.

6. The coding apparatus according to claim 1, wherein indices are assigned to the plurality of suppressing coefficients in an ascending or descending order with respect to a degree of suppressing; and wherein among the suppressing coefficients that correspond to a largest index and a smallest index, the candidate limiting section excludes a suppressing coefficient with respect to which the estimated distortion energy is larger, from the predetermined number of suppressing coefficients.

7. The coding apparatus according to claim 1, wherein the estimating section sets the number of the pulses to be estimated, in accordance with a feature of the residual spectrum, and estimates positions of the set number of the pulses.

8. The coding apparatus according to claim 7, wherein the feature is a variation in an amplitude in each band of the residual spectrum; and wherein the estimating section sets the number of the pulses so as to decrease as the variation increases.

9. The coding apparatus according to claim 7, wherein the feature is a tone feature of the residual spectrum; and wherein the estimating section sets the number of the pulses so as to decrease as the tone feature increases.

10. The coding apparatus according to claim 7, wherein the feature is a noise feature of the residual spectrum; and wherein the estimating section sets the number of the pulses so as to increase as the noise feature increases.

11. A coding apparatus, comprising:

a memory; and a processor, which performs the functions of a first coding section that outputs a spectrum of a first decoded signal that is generated by decoding a first code obtained by a first encoding of an input audio signal;

a suppressing section that suppresses an amplitude of the spectrum of the first decoded signal using a specified suppressing coefficient that is specified by a preliminary selector from among a plurality of suppressing coefficients, to generate a suppressed spectrum;

a residual spectrum calculating section that calculates a residual spectrum with respect to the specified suppressing coefficient using a spectrum of the input audio signal and the suppressed spectrum;

a preliminary selecting section that specifies the specified suppressing coefficients to the suppressing section from among a plurality of suppressing coefficients and selects a predetermined number of suppressing coefficients from among the specified suppressing coefficients using the spectrum of the input audio signal and the residual spectrum; and a second coding section that encodes the specified suppressing coefficient using a residual spectrum with respect to each of the predetermined number of suppressing coefficients, and determines one suppressing coefficient with respect to which a coding distortion caused by the second encoding is smallest, among the predetermined number of suppressing coefficients using a spectrum of a second decoded signal that is generated by decoding a second code obtained by the second encoding, the suppressed spectrum and the spectrum of the input audio signal, wherein the preliminary selecting section further comprises an estimating section that estimates a position of a pulse that is generated with respect to the residual spectrum in the second encoding, using the residual spectrum;

an attenuating section that generates an estimated residual spectrum by attenuating an amplitude at the estimated position of the pulse in the residual spectrum;

a calculating section that calculates an estimated distortion energy that is an estimated energy of the coding distortion, using the estimated residual spectrum and the spectrum of the input audio signal; and a candidate limiting section that preliminarily selects the predetermined number of suppressing coefficients among the plurality of suppressing coefficients based on the estimated distortion energy;

wherein the attenuating section attenuates an amplitude of the spectrum at the estimated position of the pulse in accordance with a feature of the residual spectrum, and wherein the coding apparatus achieves higher processing efficiency and encoding quality by processing separate portions of the input audio signal using different coding.

12. The coding apparatus according to claim 11, wherein the feature is a variation in an amplitude in each band of the residual spectrum; and the attenuating section sets a degree of attenuation of the spectrum so as to increase as the variation increases.

13. The coding apparatus according to claim 11, wherein the feature is a tone feature of the residual spectrum; and the attenuating section sets a degree of attenuation of the spectrum so as to increase as the tone feature increases.

14. The coding apparatus according to claim 11, wherein the feature is a noise feature of the residual spectrum; and the attenuating section sets a degree of attenuation of the spectrum so as to decrease as the noise feature increases.

15. A coding method, which is executed by a coding apparatus having a memory and a processor, comprising:

outputting a spectrum of a first decoded signal that is generated by decoding a first code obtained by a first encoding of an input audio signal;

suppressing an amplitude of the spectrum of the first decoded signal using a specified suppressing coefficient that is specified from among a plurality of suppressing coefficients, to generate a suppressed spectrum;

calculating a residual spectrum with respect to the specified suppressing coefficient using a spectrum of the input audio signal and the suppressed spectrum;

specifying the specified suppressing coefficients to the suppressor from among a plurality of suppressing coefficients and selecting a predetermined number of suppressing coefficients that are used in the suppressing from among the specified suppressing coefficients using the spectrum of the input audio signal and the residual spectrum, and setting the preliminarily selected suppressing coefficients as the specified suppressing coefficients; and encoding the specified suppressing coefficient using a residual spectrum with respect to each of the predetermined number of suppressing coefficients, and determining one suppressing coefficient with respect to which a coding distortion caused by the second encoding is smallest, among the predetermined number of suppressing coefficients using a spectrum of a second decoded signal that is generated by decoding a second code obtained by the second encoding, the suppressed spectrum and the spectrum of the input audio signal, wherein the preliminary selecting further comprises estimating a position of a pulse that is generated with respect to the residual spectrum in the second encoding using the residual spectrum;

generating an estimated residual spectrum by attenuating an amplitude at the estimated position of the pulse in the residual spectrum;

calculating an estimated distortion energy that is an estimated energy of the coding distortion, using the estimated residual spectrum and the spectrum of the input audio signal; and preliminarily selecting the predetermined number of suppressing coefficients among the plurality of suppressing coefficients based on the estimated distortion energy, wherein the attenuating attenuates an amplitude of the spectrum at the estimated position of the pulse by multiplying the amplitude by a coefficient having a value that is greater than or equal to 0 and less than 1, and wherein the coding method achieves higher processing efficiency and encoding quality by processing separate portions of the input audio signal using different coding.

* * * * *